United States Patent [19]

Herren et al.

[11] Patent Number: 4,735,712

[45] Date of Patent: Apr. 5, 1988

[54] METHOD OF PRODUCING WEAR LAYER ON SCREEN RAIL AND SCREEN RAIL HAVING WEAR LAYER SO PRODUCED

[76] Inventors: Harold L. Herren; Jim D. Herren, both of 409 Goodrich Ave., Platteville, Colo. 80651

[21] Appl. No.: 863,586

[22] Filed: May 15, 1986

Related U.S. Application Data

[63] Continuation-in-part of Ser. No. 516,917, Jul. 25, 1982, abandoned.

[51] Int. Cl.[4] ..... B07B 1/48

[52] U.S. Cl. ..... 209/403; 29/421 E; 29/432; 29/469.5; 156/91; 156/222; 156/245; 156/267; 156/290; 209/401; 278/173.6; 428/594; 428/603

[58] Field of Search ..... 29/432, 469.5, 421 E; 156/245, 91, 290, 291, 222, 267; 209/319, 403, 405, 414, 401; 228/140, 173.6; 428/594, 595, 603

[56] References Cited

U.S. PATENT DOCUMENTS

| | | | |
|---|---|---|---|
| 1,999,769 | 4/1935 | Lincoln | 209/403 |
| 3,101,314 | 8/1963 | Johnson | 209/319 |
| 3,139,400 | 6/1964 | Kyle | 209/403 |
| 3,203,548 | 8/1965 | Roubal | 209/403 X |
| 3,870,630 | 3/1975 | Tylinski | 209/403 |
| 4,133,751 | 1/1979 | Stengel | 209/404 |
| 4,351,886 | 9/1982 | Howie | 428/594 X |

*Primary Examiner*—Robert A. Dawson
*Attorney, Agent, or Firm*—Horace B. Van Valkenburgh

[57] ABSTRACT

A rubber wear layer is molded to a metal sheet, which is relatively thin, in comparison with a side rail for tensioning a vibrating screen, then attached to the side rail, as above a flange which provides a connection with the screen. The rubber layer and sheet may be wider than the width desired for the rail, in which event the wear layer and sheet are trimmed to the desired width, as by shearing. The rubber layer may also have a width less than the sheet, so as to leave a lip along one edge. The aforesaid attachment is made by pins propelled by an explosive charge through the bonded layer, the sheet and the plate at spaced positions. A head of each pin abuts the sheet and the portion which extends past the plate is removed, as by grinding. The sheet may be additionally attached to the rail by spot welds at spaced psitions on the lip, which prevents the heat of welding from adversely affecting the rubber. The lip is placed on the plate opposite the flange which connects with the screen. The plate is then formed, as in a press brake, along with the thin sheet and the bonded layer, to a desired non-planar lateral shape, such as including an additional flange and concave or convex curves. The lip of the sheet may also be spot welded to the rail after bending of the plate, rubber layer and sheet.

19 Claims, 3 Drawing Sheets

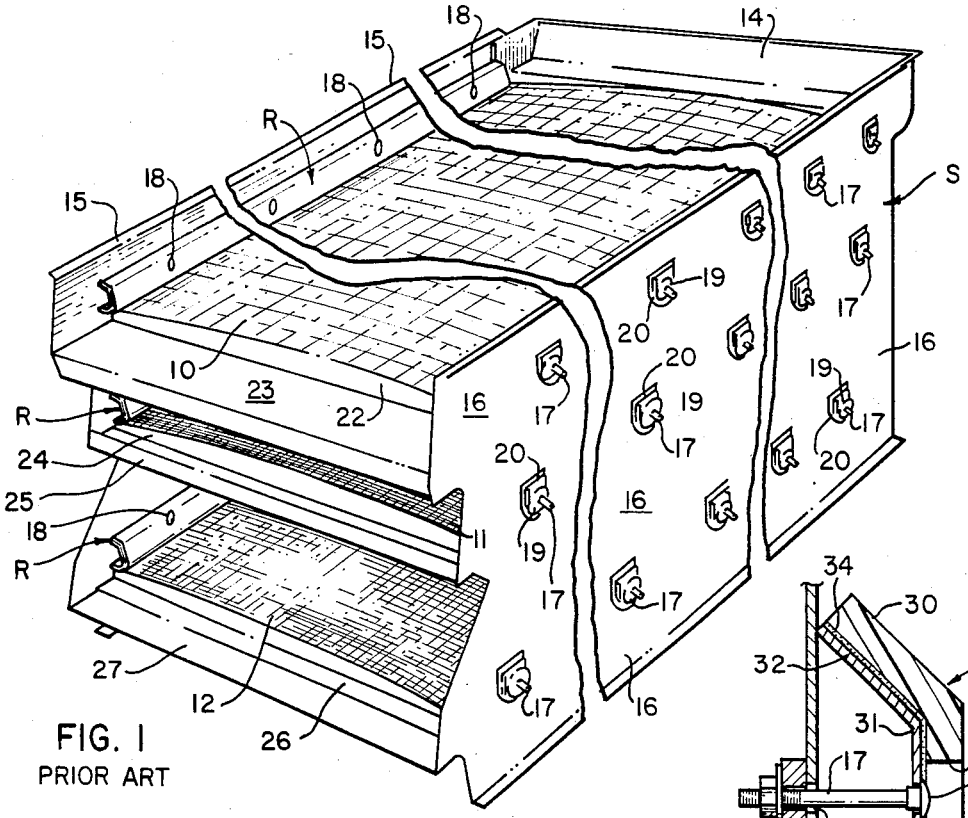
FIG. 1
PRIOR ART
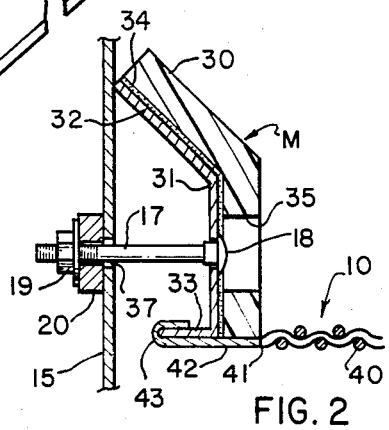
FIG. 2
PRIOR ART
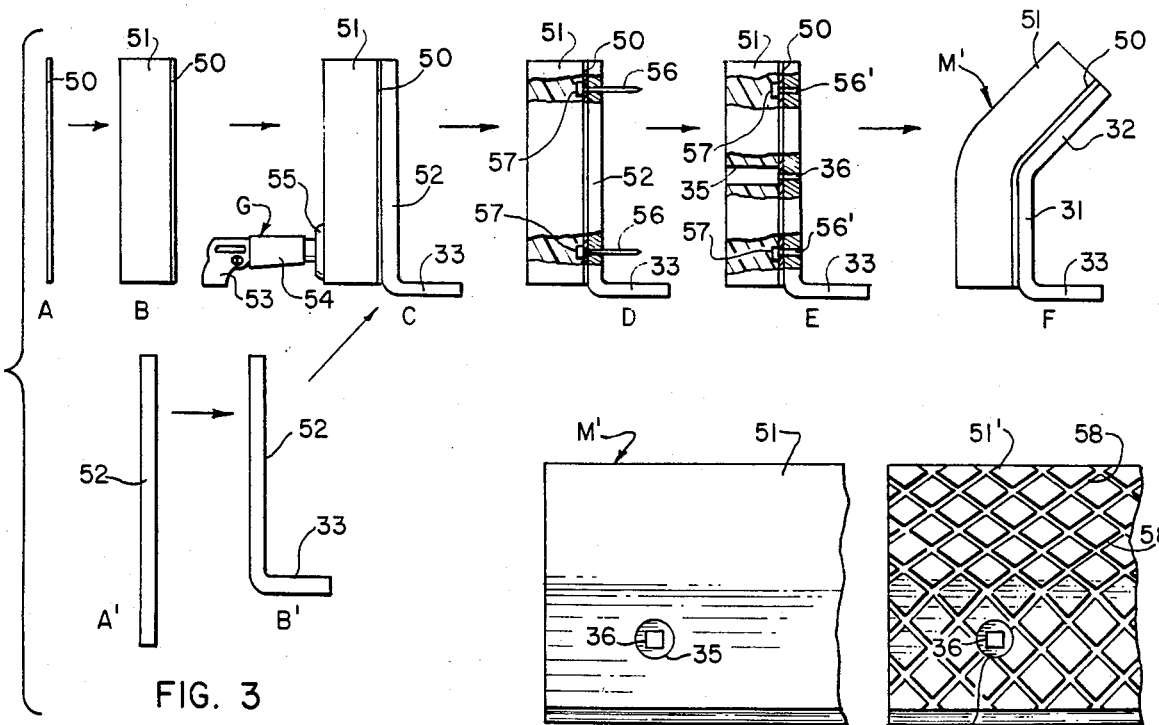
FIG. 3
FIG. 4
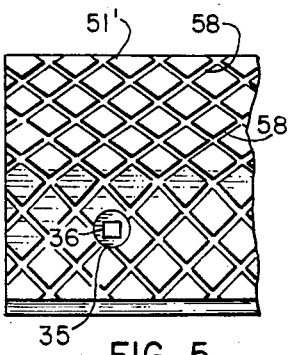
FIG. 5

METHOD OF PRODUCING WEAR LAYER ON SCREEN RAIL AND SCREEN RAIL HAVING WEAR LAYER SO PRODUCED

This application is a continuation-in-part of U.S. patent application Ser. No. 06/516,917 filed July 25, 1982 and now abandoned. This invention relates to a method of producing a screen rail and the screen rail.

BACKGROUND OF THE INVENTION

Metal side rails for tensioning vibrating screens are subject to undue wear, thus requiring relatively frequent replacement. A layer of molded rubber may be provided on the side rail, attached by adhesive above a flange which receives a side strip attached to the screen, as by welding, and has a hook which engages the flange. Such a layer increases the useful life of the side rail considerably. The rubber layer will separate from the side rail, if attached by adhesive to the side rail before the desired shape is produced, when a bending or other shaping step is taken. Thus, it is customary to mold the wear layer separately, in a width which is equal to the widest layer which might be needed and to cut or shear the rubber layer to a width and length to fit the side rail to which the rubber is to be attached. Any necessary holes for accommodating the heads of tension bolts are made through the rubber. The rail is bent to shape and then adhesive is applied to the underside of the rubber layer, which is then held against the previously bent rail until the adhesive has set. Due partly to the difficulty in obtaining a clean, oil-free surface on the rail after bending, such wear layers are not always adhered sufficiently to the rail and, therefore, have exhibited a tendency to come loose, particularly during hard usage, unusual temperature conditions and the like.

SUMMARY OF THE INVENTION

A resilient wear layer, such as rubber, is provided on a side rail for tensioning a vibrating screen, through first bonding by vulcanizing the rubber layer to a metal sheet which is relatively thin in comparison with the side rail, as on the order of a 14 or 16 gauge sheet and a ¼ inch plate for the side rail. Such a sheet is readily sheared, along with the rubber layer, if the latter is to be reduced in width or length to fit the rail to be made. The sheet is also preferably wider than the layer along one edge to leave a border, as on the order of ¼ inch, while the layer and sheet are trimmed at the opposite edge. Holes to accommodate the heads of screen tensioning bolts are also readily drilled or punched through the rubber-like layer and the thin sheet. The sheet and bonded layer are then attached to the metal side rail above the flange, which later provides a connection with the screen, before producing the non-planar shape of the side rail. The sheet and bonded layer may be attached to the plate by pins propelled by an explosive charge through the bonded layer, the sheet and the plate at spaced positions. The pins have a head which abuts the sheet and the portion of the pins which extend past the plate are removed. The sheet may be further attached to the plate by spot welds along the border with the border preferably placed at the top of the plate, opposite the flange for the screen side strip. The plate is then formed, as in a brake, along with the thin sheet and the bonded layer, to the desired non-planar lateral shape particularly an outward non-planar configuration with the rubber-like layer on the outer side of the plate. Thus, a side rail of this invention comprises a thin sheet having a rubber-like layer bonded thereto and attached at spaced positions to a thicker plate, with the plate, sheet and bonded layer having the desired non-planar lateral configuration and the plate having a flange for receiving a hook attached to the screen. An attachment device useful in conjunction with the screen rail of this invention and eliminates holes through the rubber-like layer and sheet, as well as through the rail plate, is illustrated and described herein and is disclosed and claimed in the application of Harold L. Herren, Ser. No. 663,429 filed Oct. 22, 1984 as a division of Ser. No. 516,917.

THE DRAWINGS

FIG. 1 is a condensed perspective view of a vibrating, separating screen illustrative of a prior art construction having metal side rails for tensioning the respective screens;

FIG. 2 is a fragmentary cross section, on an enlarged scale, showing a side rail of a type used for several makes of screens but having a heavy rubber layer attached by adhesive to the metal rail, to increase the resistance of the rail to wear, and further illustrating the types of bolts previously utilized to attach the rails to side panels;

FIG. 3 is a step-by-step illustration, including steps A through F, inclusive, as well as steps A′ and B′, of the method of this invention for providing a heavy rubber layer on one shape of side rail, which steps can be used for a large number of shapes of rails and widths of rubber layers;

FIG. 4 is a fragmentary elevation of the inner side of the rail of step F of FIG. 3, provided with a molded rubber layer in accordance with this invention, having holes for conventional attachment bolts;

FIG. 5 is a fragmentary elevation similar to FIG. 4 but with the molded rubber layer having a grooved surface;

DESCRIPTION OF THE PREFERRED EMBODIMENT

Figure 9:
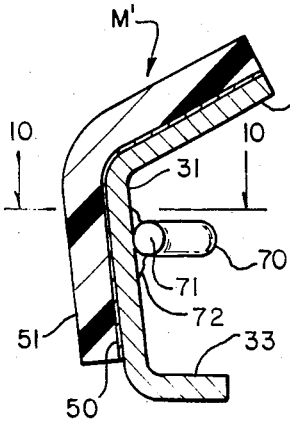
FIG. 9 is an end elevation of a side rail, to the outside of which a bracket is welded to adjustably attach the side rail to a side panel for tensioning a screen and which is useful in connection with this invention.

A vibrating screen S of FIG. 1 illustrates the type of device to which the principles of this invention are applicable. The types of material which may be separated by such a screen include sand, gravel, crushed stone and various other differently sized products. Such a vibrating screen includes a coarse screen 10, at an upper level, an intermediate screen 11 at an intermediate level and a fine screen 12 at a lower level. The device has a rear panel 14 and side panels 15 and 16, of similar thickness and between which the respective screens are stretched, as by side rails R which are held against the side panels 15 and 16 by bolts 17. Heads 18 of the bolts, of the carriage bolt type, engage square holes in the side rails and the threaded ends extend through the respective side panel to a nut 19 bearing against a washer 20. The material to be separated, such as sand, gravel or other material is dumped in front of a rear wall 14. Due to the vibration of the screens, primarily slowly forwardly and then rearwardly at an accelerated rate, the material which does not fall through the respective screen will travel forwardly. The material which is smaller than the interstices of the coarse screen 10 will fall through the screen onto the intermediate screen 11, while the material which is smaller than the interstices of the screen 11 will fall through the screen and onto the lower screen 12. Similarly, the material which is smaller than the interstices of the screen 12 will fall through that screen for collection beneath. Material which does not fall through the coarse screen 10 will travel forwardly along the screen and over the front end thereof, supported by a transversely extending, arched plate 22, and onto a discharge lip 23, from which it may be collected in a conventional manner, as through a belt or discharge trough disposed transversely beneath the lip. Similarly, the material which does not fall through the intermediate screen 11, will travel forwardly and over the front end thereof, supported by a transversely extending, arched plate 24, and onto a discharge lip 25, from which it may be collected in a conventional manner. Similarly, the material which does not fall through the fine screen 12, will travel forwardly over the front end thereof, supported by a similar arched plate 26, and onto a discharge lip 27, from which such material may be collected in a conventional manner.

In the vibrating screen S, the side rails R are of metal, as are the screens 10, 11, 12 themselves and also the side panels 15 and 16. However, due to the movement of the material along each of the screens, metal side rails wear excessively. Thus, one of the problems inherent in the use of such side rails is the frequent replacement thereof, which normally occurs considerably more often than replacement of a screen. Such replacement of the side rails involves removing the nuts and washers from all of the bolts 17 holding a particular screen, then sliding the bolts inwardly through both a side panel 15 or 16 and a side rail R. Then, the new side rail may be placed in a position and the bolts again laboriously replaced, whereupon the washers 20 and nuts 19 may be replaced.

In order to avoid the expense involved in changing worn metal side rails, during which time the vibrating screen cannot be used, a separately molded rubber layer 30 may be attached to the side rail of FIG. 2, such as by adhesive 34. The metal portion of side rail M of FIG. 2, which is protected against wear by the molded rubber layer 30, has a central portion 31, an inclined upper flange 32 and a perpendicular lower flange 33. Also, the side rail M of FIG. 2 is provided with a hole 35 in the rubber layer and a square hole 36 in the side rail to accommodate the carriage type head 18 of the bolt, while the side panel 15 is provided with a hole 37 for passage of the bolt 17 therethrough. There are a number of shapes of side rails utilized for various types of vibrating screens, the type illustrated in FIG. 2 being what is referred to as a "standard rail" because it is used on the order of seven or more different types of vibrating screens, including the "Tyler" screen illustrated in FIG. 1, although the side rail R, supplied by the manufacturers of the "Tyler" screen, has a different configuration, as shown in FIG. 8. Other different shapes of side rails, supplied by manufacturers of two types of vibrating screens, are illustrated to show the wide variation in shape of rail and width of rubber layer for which this invention may be utilized. These are the "Eljay" illustrated in FIG. 6 and the "Simplicity" illustrated in FIG. 7.

It has been customary to provide a molded rubber layer 30 on a side rail as in FIG. 2, by first molding the rubber to the desired thickness, such as having a greater thickness than the plate, cutting to width or length, if necessary, and then attaching by adhesive to the side rail after the metal side rail has been given its final shape. The rails are made of plate, on the order of one-fourth inch thick. If the rubber is attached by adhesive to a plate of such thickness prior to bending, any attempt to bend the plate to produce a different shape results in the rubber separating from the plate. Many purchasers do not obtain side rails with a molded rubber layer attached thereto by adhesive, in view of the tendency for the rubber layer to separate from the plate.

Each of the screens 10, 11 and 12, may be constructed in a similar manner, as in FIG. 2, from longitudinal wires 40 and lateral wires 41, the ends of the latter, at each side of the screen being attached, as by welding, to the edge of a side strip 42. For stretching the screen, strip 42 is provided with a hook 43, which engages the outer edge of lower flange 33 of the side rail. As will be evident, when nut 19 is tightened on bolt 17, side strip 42 will be pulled toward side panel 15, so that when bolts 17 have been appropriately similarly tightened on each side, the screen will become taut between the side rails.

In accordance with the present invention, a side rail of any present conventional shape may be provided with a molded rubber, wear-resistant layer in a relatively simple and economical manner, which requires only one size of mold to be used. The procedure by which this is accomplished is illustrated by steps A through F and accompanying steps A′ and B′ of FIG. 3. Step A illustrates a strip 50 which is very thin, such as 14 to 16 gauge, in comparison with the rail R and can be readily shaped. In step B, a rubber layer 51 is molded on strip 50, of a depth to produce the desired thickness and having a length equal to that of strip 50. Before molding the rubber layer on strip 50 by vulcanization, the strip is first cleaned and sand-blasted to provide the optimum surface for adhesion of the rubber.

The initial width of strip 50 and rubber layer 51 corresponds to the maximum width of rubber layer desired, but the strip and rubber layer are cut to an appropriate lesser width which will correspond to the portion of the rail to which the rubber layer and strip are to be attached. Step A' illustrates a plate 52, such as quarter inch steel, which is to be used as the basic metal part of the side rail and, in step B' is bent, as in a press brake, to produce lower flange 33 of side rail M'. It will be noted that the difference in width between thin strip 50 and molded rubber layer 51 after trimming, on the one hand, and plate 52, on the other hand, corresponds generally to the width of plate necessary to produce lower flange 33 which, as evident from FIG. 2, does not normally engage the material moving along the screen. Step C illustrates the attachment of thin sheet 50 with its rubber layer 51 molded on it, to plate 52, sheet 50 being placed against plate 52 above flange 32 as well as a gun G, which may be any one of several types, the Ram-set Jobmaster Model 122 MD having been found to be satisfactory for the purpose. This gun is provided with a handle 53 with which a trigger is associated and a barrel 54, as well as a safety shield 55, which is normally spaced from the barrel and must be pressed against the work piece to the position of step C, before the gun can be fired. Gun G is placed against rubber layer 51 at the positions at which a pin 56 of step D is to be fired, by means of an explosive charge, through rubber layer 51, sheet 50 and plate 52. Pins 56 may be placed at appropriate lateral positions, such as near flange 32 and also near the opposite edge of plate 52, with the spacing between pins 56 longitudinally of plate 52, being much greater than the lateral spacing indicated, such as a longitudinal spacing on the order of 2 to 3 feet, whereas the lateral spacing shown is a matter of inches. Each pin 56 has a head 57, which may be semicircular and which is stopped by sheet 51 which is metal and backed by plate 52. However, pin 56 should be fired with sufficient velocity to penetrate plate 52. Also, it has been found that the length of pin 56 should be sufficient that the point of the pin has penetrated through plate 52 before the head 57 reaches the rubber layer 51. Even though head 56 moves through rubber layer 51, which normally closes after its passage to leave little or no visible indication so that head 57 is buried in the rubber after the point of the pin has moved clear through plate 52, tests showed that unless the point had penetrated through the plate before the head 57 had reached the rubber, then the rubber would stop the head and a secure attachment of sheet 50 to plate 52 would not be obtained. In any event, it was found that a secure attachment of sheet 50 to plate 52 was readily obtained.

The side rail M' of step F of FIG. 3 is shown in FIG. 4 as having holes 35 in the rubber and square holes 36 in the metal rail portion 31 to accommodate bolt heads 18. The surface of the molded rubber of rail M' is shown in FIG. 4 as being smooth. However, the rubber layer may be provided with any desired series of notches or grooves, such as grooves 58 of FIG. 5 with which rubber layer 51' is provided, as to simulate a tire tread.

Figure 16:
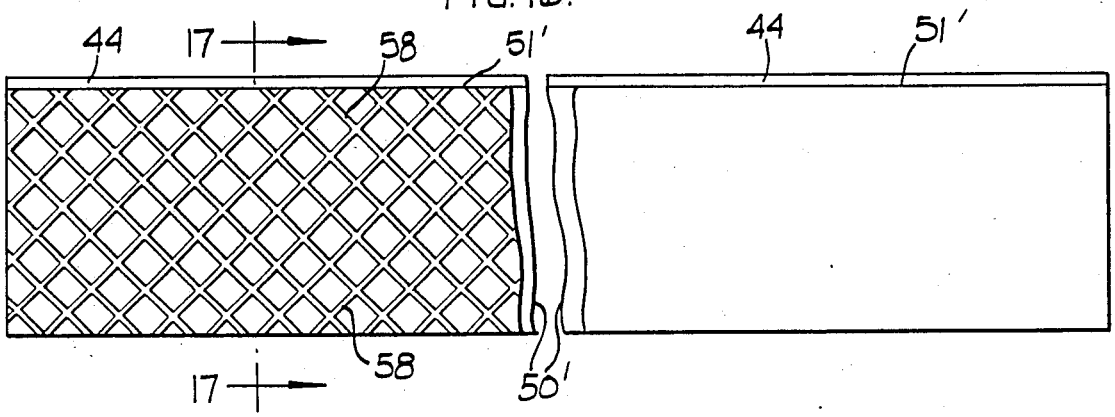
FIG. 16 is a condensed elevation of a molded rubber layer vulcanized onto a relatively thin sheet.
Figure 17:
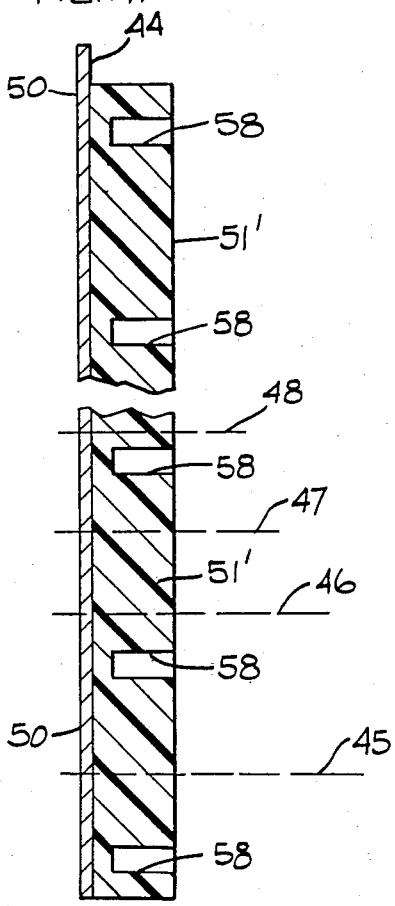
FIG. 17 is a condensed vertical section, on an enlarged scale, taken along lines 17—17 of FIG. 16.
Figure 18:
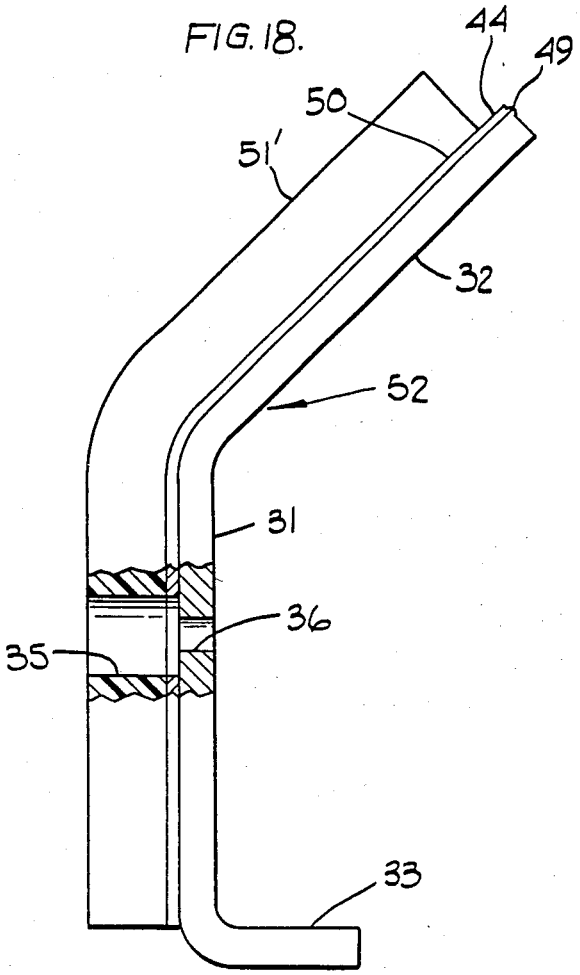
FIG. 18 is a side elevation similar to step F of FIG. 3 but on an enlarged scale, showing the sheet and vulcanized rubber layer additionally attached to the rail.

As shown in FIGS. 16 and 17, a rubber layer 51' may be vulcanized to a sheet 50 leaving a lip 44 at one edge. The sheet and molded rubber may be used as produced if the width is appropriate, but if not, the opposite edge may be trimmed by a shear, such as along lines 45, 46, 47 or 48, or other positions, so that the trimmed piece including lip 44 will extend to the desired position from the upper edge of the plate. Necessary holes 35 may be drilled or punched through the rubber and sheet, corresponding in position to holes 36 in the plate. The sheet and its molded rubber is placed with lip 44 at the upper edge of the plate and attached, as before, by pins 56 shot through the rubber, sheet and plate, with the pin heads 57 abutting sheet 50. After the protruding portion of the pins have been removed, as in step E of FIG. 3, the rail and attached strip with molded rubber, are bent to the desired shape, as in a press brake. This may produce the shape of step F of FIG. 3 or the rail of FIG. 18, in which a tack weld 49 more firmly anchors the strip 50 to the rail 52. The lip 44 tends to protect the vulcanized rubber from possible damage due to the heat of welding. A series of tack welds 49 may be spaced along the rail intermittently with pins 56 or also with one at each end of the rail. The tack welds may be placed before or after bending with the latter preferred.

It is important that the sheet and vulcanized layer be attached to the plate prior to bending transversely, since attempts to bend these parts separately, then attach them together, have not been successful. Apparently, the sheet is not thick enough to maintain its shape due to tension in the rubber when located on the outside of the bend, so that, even when initially bent to the same shape, the plate maintains its shape, but the sheet and molded rubber layer do not. Thus, when the sheet and rubber layer are attached to the plate after each is bent, the sheet and rubber layer do not conform and irregularities in attachment are produced which may result in the sheet and rubber layer coming loose at one or more places and eventually separating from the plate. The difficulty in preparing the surface of a plate normally used to form a side rail, in order to successfully vulcanize a molded rubber layer thereto, is apparently responsible for the lack of any side rail on the market having a molded layer vulcanized thereto prior to bending. It is noted that a 14 or 16 gauge sheet is very clean in comparison with quarter inch plate, but even such a sheet must be sand-blasted to provide a sufficiently clean surface.

Figure 6:
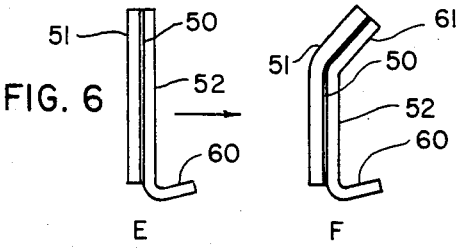
FIG. 6 is an illustration showing the last two steps, E and F, in producing a different shape of side rail requiring a different width of rubber layer, the previous steps being identical to those of FIG. 3.

As indicated, other shapes of side rails with molded rubber layers may be produced in accordance with this invention. For instance, a side rail known as the "Eljay" is illustrated in FIG. 6. Steps A through D, A' and B' of FIG. 3, precede the steps shown in FIG. 6, but step B' is modified to produce a lower flange 60 somewhat shorter than flange 33 of FIG. 3. Also, the molded rubber layer 51 or 51' and strip 50 are trimmed to a different width than in FIG. 3. Step E of FIG. 6 is similar to step E of FIG. 3, in that the attaching pins are ground off and bolt holes, if desired, are also provided, although the bolt holes in the flange are completely unnecessary when the rail attachment device useful with this invention, described below, is utilized. Step F of FIG. 6 illustrates the production, as in a press brake, of an upper flange 61 of both a different extent and a different angularity than upper flange 32 of FIG. 3.

Figure 7:
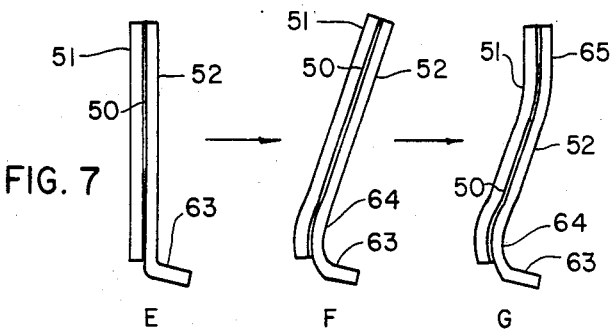
FIG. 7 is similar to FIG. 6, but shows the last three steps, E, F and G, in producing another different shape of side rail requiring another different width of rubber layer.
Figure 8:
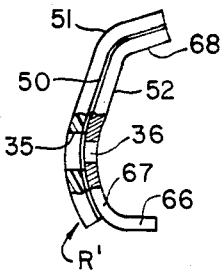
FIG. 8 is a side elevation of another shape of side rail, corresponding to that shown in FIG. 1, but provided with a molded rubber layer in accordance with this invention.

The side rail illustrated in FIG. 7 is the "Simplicity" type, which includes a reverse or convex curve. Again steps A through D, A' and B' of FIG. 3 are utilized, with a slight difference in step B' in that a flange 63 of a different extent and at a different angle is provided.

Also, the molded rubber layer 51 and strip 50 are trimmed to a different width. Step E of FIG. 7 shows sheet 50 and rubber layer 51 after attachment to plate 52, with flange 63, while step F illustrates the production, as in a press brake, of a slight concave curve 64 adjacent lower flange 63. Step G illustrates the similar production of a curve 65, as a reverse curve, toward the upper end of the side rail. Rail R' of FIG. 8 corresponds to rail R of FIG. 1, plate 52 being identical to rail R, and rail R' differing only in the addition of sheet 50 and rubber layer 51, trimmed to an appropriate width. Rail R' is produced by steps similar to steps A through D, A' and B' of FIG. 3, with a lower flange 66 being produced in step B'. Further steps in producing rail R' correspond to steps E and F of FIG. 7, with flange 66 being present in step E and curve 67 being produced in step F. In the final step, upper flange 68 is produced in a manner similar to the production of upper flange 61 of FIG. 6.

Figure 10:
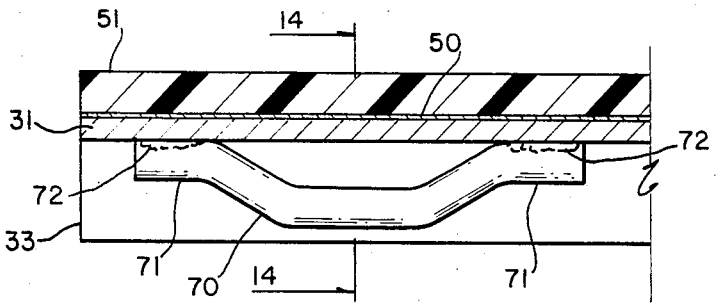
FIG. 10 is a fragmentary section taken along line 10—10 of FIG. 9.
Figure 11:
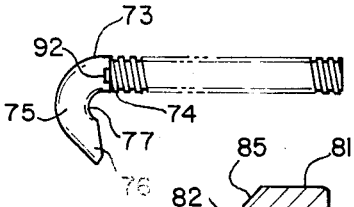
FIG. 11 is a side elevation of a hook bolt which is part of an attachment device and cooperates with the bracket of FIGS. 9 and 10 for tensioning a screen.
Figure 12:
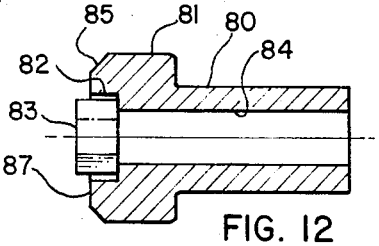
FIG. 12 is a side elevation of a barrel, in section, and a nut which are also parts of the attachment device.
Figure 13:
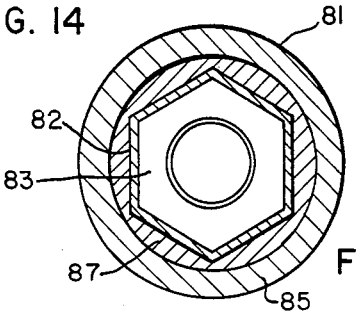
FIG. 13 is an end view of the nut of FIG. 12 in position within a socket of the barrel.

Adapted for use with the rail of this invention, as well as other rails, a more expeditious and convenient type of attachment device for connecting a side rail to a side panel is provided. This device eliminates the necessity, when installing a side rail, for introducing the bolts through the side rails and the side panels, as well as the necessity for replacing the nuts and washers on the bolts outside the side panels, prior to tightening the bolts. This device further eliminates the necessity, when removing a side rail, for removing the nuts and washers from the bolts, as well as the necessity for sliding the bolts inwardly to remove them from the side rails. A first part of such a device is illustrated in FIGS. 9 and 10 and comprises a bracket rod 70, which is formed so that the center of the rod will be spaced outwardly an appropriate distance from the rear of a side rail portion 31, as in FIG. 10, and the ends 71 of which are attached to the rear of a rail portion 30, as by welds 72. The second part of the device is illustrated in FIGS. 11–13, which show the unassembled components. The components include a bolt 73 of FIG. 11 having threads 74, preferably Acme type threads, and a hook 75 at its inner end which terminates in a tapered point 76. The radius of arc 77, on the inside of hook 75, corresponds to the radius of rod 70 of FIGS. 9 and 10 so that hook 73 will securely engage rod 70, as in FIG. 14.

The components of the attachment device further include a barrel 80, which is hexagonal on the outside so as to be turnable by a conventional wrench and merges into larger, cylindrical collar 81. As in FIGS. 12 and 13, collar 81 is provided with a hexagonal socket 82, adapted to receive a nut 83, with clearance as in FIG. 13. A cylindrical bore 84 extends axially of barrel 80 and to socket 82, while collar 81 has an outer conical surface 85, which may slope at a suitable angle, such as 45 degrees, so that a weld 86 of FIG. 14 will form a continuation of conical surface 85. Weld 86 fills the clearance space between socket 82 and nut 83, as well as being deposited on a land 87, which surrounds socket 82, to extend to the outer end of nut 83. The thickness of nut 83 exceeds the depth of socket 82 an amount such that an extension of conical surface 85 will intersect the apices of the hexagon of the extending nut. By filling in the weld metal to such a cone, a conical surface is provided to abut a bevel 90 of FIG. 15, at the outer edge of a hole 91 in side panel 16. In order to admit hook 75, hole 91 should have a diameter on the order of twice that of bolt 73.

Figure 14:
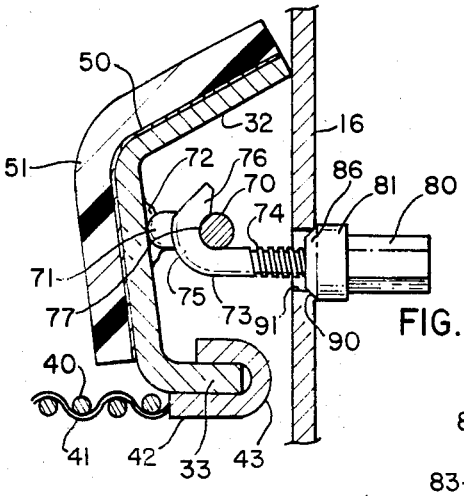
FIG. 14 is a fragmentary section, taken at the position of line 14—14 of FIG. 10, showing the manner in which the hook bolt of FIG. 11 may be used to tension a screen.
Figure 15:
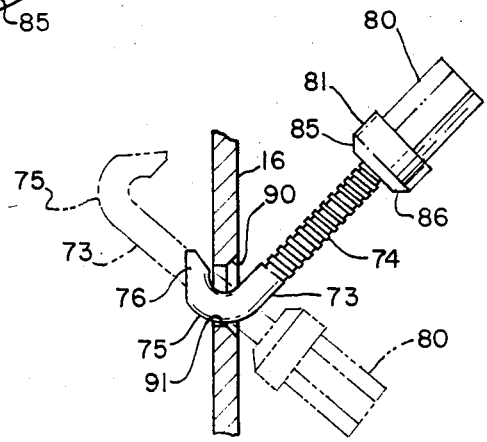
FIG. 15 is a fragmentary section showing the manner in which the attachment bolt may be inserted through a hole in a side panel and also, in dotted lines, how the attachment device may be stored while a worn side rail and/or screen is being replaced.

Nut 83 has Acme threads to fit threads 74 of bolt 73, so that a wrench may be used to turn the barrel 80 for tightening the screen after bolt 73 has been engaged with bracket rod 70, as in FIG. 14. The position of bracket rod 70 is sufficiently above screen hook 43 that there will be ample room for engagement of hook 75 with rod 70. Since bracket rod 70 is not visible from the outside of panel 16, a simple strategem may be used for ensuring engagement of hook 75 with rod 70, i.e., a flat mark 92 may be placed on bolt 73, as by grinding rearwardly of hook 75 and on one side, at 90 degrees from the hook. Since hook 75 may be pulled rearwardly without difficulty when disengaged, when hook 75 abuts the inside of panel 16, mark 92 will be visible and bolt 73 may be turned until mark 92 is upward. Then, bolt 73 may be moved forwardly until hook 75 abuts plate 31, whereupon bolt 73 may be turned through 90 degrees in a clockwise direction, then pulled slightly for engagement of hook 75 with bar 70. Tension may be maintained on bolt 73 while barrel 80 is turned to cause nut 83 to be threaded along bolt 73 until conical weld 86 first engages bevel 90, then a wrench may be used to turn barrel 80 to tighten nut 83 on bolt 73 and pull the screen tight or to a position in which the opposite bolt 73 will pull the screen tight.

For initially inserting a bolt 73 in a hole 91, which may be produced by enlarging hole 37 in panel 15 of FIG. 2 and producing bevel 90 at the same time, barrel 80 may be held close to panel 15 while inserting point 76 through the hole. Then, barrel 80 may be turned toward a horizontal position, such as toward and past the position of FIG. 15, while hook 75 is inserted into the hole, so that bolt 73 may be pushed into the hole as far as desired. If bar 70 is to be engaged by hook 75, the bolt is turned so that mark 92 is on top, after which the procedure described previously may be followed. The manner in which the bolt 73 may be stored on the panel 16 when disconnected from the side rail, is illustrated in dotted lines in FIG. 15, in which the bolt 73 is placed in hole 91 with the lower side of the bolt against the lower edge of bevel 90 and the upper side against the upper inner edge of hole 91. The weight of barrel 80 pulls downwardly on the bolt, to maintain it in storage position, while the Acme threads 74 contribute to the stability of the position. When the bolt is again to be used, it is necessary only to move it to a horizontal position, pull it outwardly until mark 92 of FIG. 11 is visible and uppermost, then reinstall the bolt in the manner described previously.

Although different embodiments of the method of providing a rubber layer on a side rail and the resulting side rail have been illustrated and described, it will be understood that other embodiments may exist and that various changes may be made therein without departing from the spirit and scope of this invention.

What is claimed is:

1. A method of providing a resilient wear layer of rubber and the like on a relatively heavy metal rail having a non-planar lateral configuration, comprising:

bonding by vulcanization said wear layer onto a clean, flat metal sheet which is relatively thin in comparison with said plate and having a width not less than the width of the desired extent of said wear layer on said rail;

attaching said sheet, with said wear layer bonded thereto, at spaced positions to a flat portion of a relatively heavy metal plate adapted to be formed to provide said lateral configuration; and forming by bending said plate with said thin sheet with said wear layer attached thereto, to said non-planar lateral configuration.

2. A method as defined in claim 1, wherein:

said sheet and molded layer bonded to said sheet is wider than the width of the desired extent of said wear layer on said rail; and trimming said sheet and layer bonded thereto to a width corresponding to the desired extent of said wear layer on said rail prior to attachment of said sheet and bonded layer to said plate.

3. A method as defined in claim 1 including:

bonding said wear layer to said sheet at a position leaving a lip along one edge of said sheet onto which the rubber layer is not molded; and attaching said sheet and molded layer to said plate including welding said strip to said plate at spaced positions along said lip.

4. A method as defined in claim 3, wherein:

said plate has a thickness generally on the order of said wear layer.

5. A method as defined in claim 1 including:

bonding said wear layer to said sheet at a position leaving a lip along one edge of said sheet onto which the wear layer is not molded; and attaching said strip and molded layer to said plate prior to forming said non-planar lateral configuration.

6. A method as defined in claim 5, wherein said molded layer bonded to said sheet is wider than the width of the desired extent of said wear layer on said rail; and trimming said sheet and layer bonded thereto to a width corresponding to the desired extent of said wear layer on said rail prior to attachment of said sheet and bonded layer to said plate.

7. A method as defined in claim 1, wherein:

the comparative thickness of said plate is on the order of one-fourth inch, and of said thin sheet is on the order of 14 or 16 gauge.

8. A method as defined in claim 1, which includes:

attaching said sheet to said plate by causing pins to extend through said sheet and said plate.

9. A method as defined in claim 8, wherein each pin has a head and a length exceeding the thickness of said wear layer, said sheet and said plate and including:

providing a sufficient velocity to each pin to penetrate said wear layer, said sheet and said plate, until said head abuts said sheet; and removing the portion of said pin which extends beyond said plate.

10. A method as defined in claim 9, including producing said velocity through an explosive charge.

11. A method as defined in claim 1, wherein:

forming said plate, sheet and wear layer to said non-planar configuration includes bending said plate, sheet and wear layer to form a concave curve.

12. A method as defined in claim 1, wherein:

forming said plate, sheet and wear layer to said non-planar configuration includes bending said plate, sheet and wear layer to form a convex curve.

13. A side rail for tensioning a vibrating screen and having a non-planar lateral configuration and a molded wear resilient layer at a position including said non-planar lateral configuration comprising:

a relatively heavy metal plate formed to said non-planar lateral configuration;

a relatively thin metal sheet attached to said plate at a plurality of positions;

a wear layer vulcanized to said thin metal sheet;

said metal sheet having a lip along one side extending beyond said wear layer;

said metal sheet with said vulcanized wear layer being formed to esentially the same lateral configuration as the corresponding portions of the metal plate; and a series of welds attaching said sheet to said rail at spaced positions along said lip.

14. A side rail as defined in claim 13 including:

a series of pins, each having a stem extending through said sheet and said plate and a head disposed within said wear layer, said stems of said pins terminating at said plate on the opposite side from said wear layer.

15. A side rail as defined in claim 13, wherein:

said non-planar configuration of said plate, sheet and wear layer includes a concave curve of said wear layer.

16. A side rail as defined in claim 13, wherein:

said non-planar configuration of said plate, sheet and wear layer includes a convex curve of said wear layer.

17. A side rail as defined in claim 13, wherein:

said plate has a thickness generally on the order of said wear layer.

18. A side rail as defined in claim 13, wherein:

the comparative thickness of said plate is on the order of one-fourth inch, and of said thin sheet is on the order of 14 to 16 gauge.

19. A method as defined in claim 5, wherein said lip is placed along one edge of said plate and including:

welding, as by spot welds, said lip to said plate after bending to said non-lateral configuration.

* * * * *